United States Patent [19]

Mucic

[11] Patent Number: 4,955,931

[45] Date of Patent: Sep. 11, 1990

[54] RESORPTIVE THERMAL CONVERSION APPARATUS

[75] Inventor: Vinko Mucic, Walldorf, Fed. Rep. of Germany

[73] Assignee: TCH Thermo-Consulting-Heidelberg GmbH, Heidelberg, Fed. Rep. of Germany

[21] Appl. No.: 335,966

[22] PCT Filed: Jul. 7, 1988

[86] PCT No.: PCT/EP88/00607

§ 371 Date: Feb. 27, 1989

§ 102(e) Date: Feb. 27, 1989

[87] PCT Pub. No.: WO89/00665

PCT Pub. Date: Jan. 26, 1989

[30] Foreign Application Priority Data

Jul. 20, 1987 [DE] Fed. Rep. of Germany ..... 3723938

[51] Int. Cl.[5] ..... F25B 27/00

[52] U.S. Cl. ..... 62/238.3; 62/324.2; 62/335.476

[58] Field of Search ..... 62/335, 324.2, 476, 62/238.3

[56] References Cited

U.S. PATENT DOCUMENTS

| | | | |
|---|---|---|---|
| 4,586,344 | 5/1986 | Lutz et al. | 62/335 X |
| 4,594,857 | 6/1986 | Mucic | 62/324.2 X |
| 4,745,768 | 5/1988 | Schorr et al. | 62/335 X |
| 4,777,802 | 10/1988 | Hashizume | 62/335 |

*Primary Examiner*—Lloyd L. King

[57] ABSTRACT

The resorptive thermal conversion apparatus operating with a binary refrigerant such as a mixture of ammonia and water and having at least one compression machine and one expansion machine, has two solution circuits (I; II) coupled with one another, in which thermal energy at different pressure and temperature levels in each is put in or removed for resorption or absorption, as the case may be. The gaseous refrigerant component driven by evaporation from the rich solution of the one solution circuit (I) which is at a low pressure level is compressed by the compression machine (26) to the higher pressure level of this circuit, and the gaseous refrigerant component of the other solution circuit driven out of the rich solution at the higher pressure level of the other solution circuit (II) is expanded by an expansion machine (46) to the lower pressure level of this other solution circuit. The two solution circuits (I; II) are directly coupled at an intermediate pressure level ($p_2$) which is the high pressure level of the one solution circuit (I) and the low pressure level of the other solution circuit (II).

4 Claims, 2 Drawing Sheets

RESORPTIVE THERMAL CONVERSION APPARATUS

The invention relates to a resorptive thermal conversion apparatus combined with at least one compression machine and one expansion machine, such as a heat pump, a refrigeration machine or heat engine, which is operated with a binary refrigerant, preferably a mixture of ammonia and water, for the purpose of converting thermal energy supplied by an external heat source to thermal energy at a different temperature level, and which has two solution circuits coupled together in which thermal energy at different pressure and temperature levels is put in for the evaporation of the refrigerant or removed for absorption or resorption, while the gaseous component of the refrigerant, driven by evaporation at a low pressure level from the rich solution of the one solution circuit, [is compressed] by the compression machine to the higher pressure level of this solution circuit, and the gaseous component of the refrigerant of the other solution circuit, driven from the rich solution at the higher pressure level of the other solution circuit, is expanded by an expansion machine to the lower pressure level of this other solution circuit.

Known thermal conversion apparatus of this kind, operating with at least one compression machine and one expansion machine (DE-PS 35 36 953) and having two solution circuits, are more efficient developments of older known resorptive thermal conversion apparatus having two solution circuits (DE-PS 33 44 599, DE-PS 34 24 950). In the known thermal conversion apparatus the two solution circuits are operated independently of one another as closed solution circuits, and their continuous operation requires that the balance of quantity and concentration between the two circuits be equalized to avoid differences of concentration in the circuits due to different amounts of gaseous binary refrigerant components being exchanged between the circuits. While this was originally assured by exchanging the gaseous binary refrigerant component exclusively in vapor form in equal amounts and in the same concentration both on the high-pressure side and on the low-pressure side, and the matching of the concentration required the use of a rectifying column in the branch in which, without such rectification, one gaseous component would be exchanged with an excessively high concentration, the cost and complexity of the rectifying column in the above-mentioned known thermal conversion apparatus was reduced simply by the fact that, instead of the rectifying column, an additional equalizing connection was provided between the two solution circuits, through which liquid refrigerant was pumped in a controlled manner from one to the other solution circuit precisely in such an amount that concentration differences in the two solution circuits due to different amounts (and concentrations) of the gaseous refrigerant components exchanged on the high-pressure and low-pressure sides were compensated. Yet this still requires the continuous measurement of the amounts and concentrations of the refrigerant components exchanged in gas form and a corresponding control of the amount of the liquid refrigerant component flowing through the compensating connection. That is to say, even in these cases a complex control of the process is necessary.

It is the purpose of the invention to improve the known thermal conversion apparatus operating with at least one compression machine and one expansion machine such that the complexity of its apparatus and controls, and consequently the invested cost, will be reduced, while the apparatus will at least suffer no impairment of its efficiency, even when the conditions of operation in the two solution circuits changes.

Setting out from a thermal conversion apparatus of the kind described above, this purpose is accomplished in accordance with the invention in that the two solution circuits are coupled together by connecting the output of the one solution circuit, without the interposition of controlling or regulating means, to the return of the other solution circuit at a common average pressure level which represents the high pressure level of the one solution circuit and the low-pressure level of the other solution circuit. In this circuitry, in which the two solution circuits are thus at different pressure levels, the high pressure of the one circuit being equal to the low pressure of the second circuit, it is possible to combine in one common unit a functional unit which formerly had to be provided separately in each of the two circuits, while the control of differences of concentration in the circuits is eliminated since they are directly coupled, i.e., the binary refrigerant has the same concentration in both circuits, so that there is no need for a controlled exchange of refrigerant between the circuits for the purpose of equalizing their concentration.

When the thermal conversion apparatus is arranged as a heat pump or refrigeration machine, the configuration is best made such that the resorber of the first solution circuit that is at a low pressure level and the absorber of the second solution circuit at a higher pressure level are combined in a common sorption unit in which, on the one hand, the gaseous refrigerant component driven out at low pressure and low temperature in the evaporator of the first solution circuit is resorbed in the poor solution at an intermediate temperature after its pressure and temperature are raised by the compression machine, and, on the other hand, the gaseous refrigerant component driven out at high pressure and high temperature in the evaporator of the second solution circuit is absorbed in the poor solution at an intermediate temperature in the expansion machine, with reduction of pressure and temperature, at the common average pressure level. An important advantage of this heat-pump system with directly coupled solution circuits is that the ratio of the gaseous refrigerant component driven out at the low temperature and low pressure in the evaporator of the first solution, and at high temperature and high pressure in the evaporator of the second solution circuit, can be in absolutely any desired ratio, so that, in other words, even a heat source of low temperature and one of high temperature, with extremely different or even varying amounts of heat production, can be combined.

When used as a heat engine, the configuration on the other hand will be such that the evaporator of the first solution circuit at high pressure level and the evaporator of the second solution circuit at low pressure are combined in a common evaporator in which gaseous refrigerant component at the medium pressure level and at a intermediate temperature is driven out of the rich solution and then, after a partial increase in pressure and temperature by the compression machine, is fed to the resorber of the first solution circuit, and, after a partial reduction of pressure and temperature in the expansion machine, to the absorber of the second solution circuit, where it is resorbed and absorbed, as the case may be, in the poor solution. The heat engine circuit thus configured has the important advantage that the gaseous refrigerant component driven out in the evaporator can be distributed to the solution circuits in any desired ratios. That is to say, either a larger part of the gaseous refrigerant component can be used for the production of useful heat of high temperature, by means of a pressure increase followed by resorption, and a correspondingly lesser part can be used by pressure reduction in an expansion machine, for the production of mechanical energy, or vice, depending on whether thermal energy or mechanical energy is required in the particular application.

The invention is further explained by the following description of two embodiments, in conjunction with the drawing, wherein:

FIG. 1 shows the circuitry of an embodiment, identified as a whole by 10, which is constructed as a heat pump, while in FIG. 2 the representation is such that the horizontal position of the working components and lines represented indicates concentration and the vertical position the pressure in the binary refrigerant.

The apparatus 10 has two solution circuits I and II for the refrigerant consisting preferably of a mixture of ammonia and water, the solution circuits being directly coupled, as will be further explained below.

Figure 2:
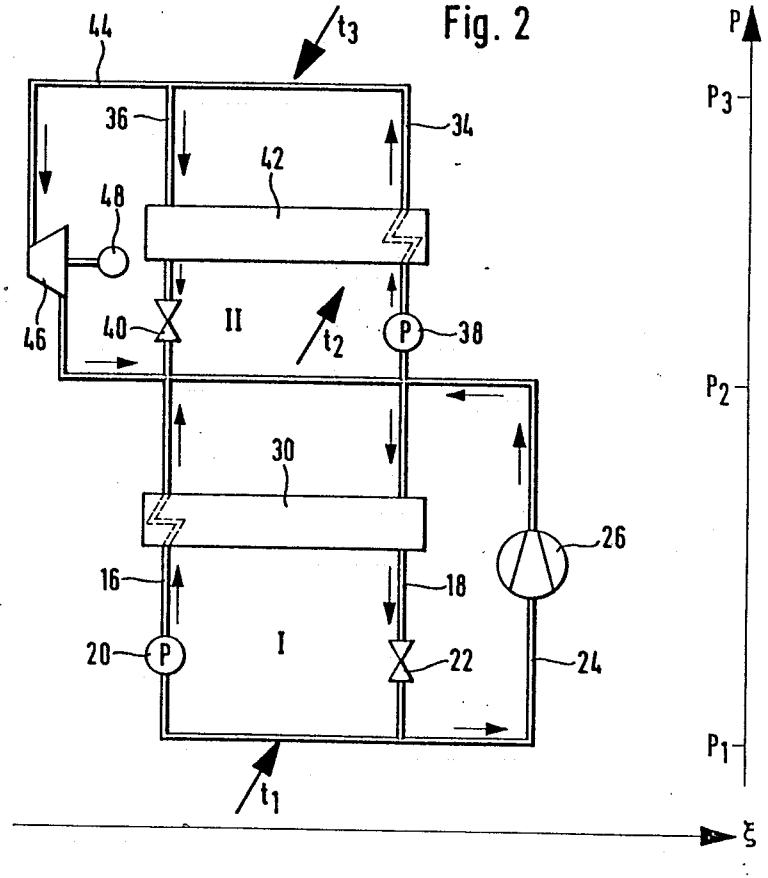
FIG. 2 shows the changes in the state of the refrigerant which take place in the heat pump in accordance with FIG. 1, in a p-$\xi$ graph.
Figure 1:
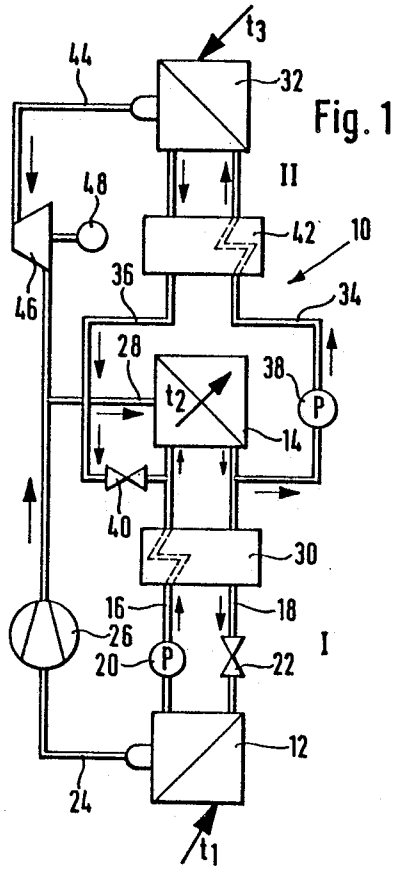
FIG. 1 is a circuit diagram of an embodiment of the thermal conversion apparatus in accordance with the invention, which is operated as a heat pump.

The solution circuit I represented at the bottom of FIG. 1 has an evaporator 12 and a sorption unit 14 which represents the resorber of this solution circuit; they are connected together by lines 16 and 18 into which the solution pump 20 and the throttling means 22 are inserted. In the evaporator 12, which is at the low pressure $p_1$, the gaseous refrigerant component is driven out of the rich solution of the refrigerant flowing in through line 18 by the input of heat at a low temperature level $t_1$ into a line 24 containing a compressor 26 in which the gaseous refrigerant component is compressed to an intermediate pressure $p_2$. The poor solution issuing from the evaporator 12 through line 16 then is pumped by the solution pump 20, which raises its pressure also to $p_2$, to the sorption unit 14 which is connected by a branch line 28 to the line 24, so that gaseous refrigerant component fed back in it through the branch line 28 can be resorbed again in the poor solution, while resorption heat is produced at an intermediate temperature $t_2$ which is higher than $t_1$ and can be put out as useful heat. Rich solution then flows from the sorption unit 14 back through line 18 to the evaporator 12, while the throttling means 22 lowers the pressure again to $p_1$. By means of a heat exchanger 30 connected in the area of the intermediate pressure $p_2$ between lines 16 and 18, thermal energy contained in the rich solution is transferred to the poor solution. To the extent thus far described, the apparatus is virtually a binary-refrigerant compression heat pump in which additional measures can be taken to improve its efficiency, such as the measures disclosed in the not-prepublished patent application P 37 16 642.5 for the additional evaporation of the poor solution to a pressure between $p_1$ and $p_2$ by means of heat transfer from the rich solution and compression of the gaseous refrigerant component thereby released to the pressure $p_2$ and pumping of the additionally produced amount of gaseous refrigerant to the sorption unit. But since these measures are not subject matter of the present application, they are not described in detail within the scope of the present application and, for the sake of simplicity, are not represented in the drawing.

The apparatus 10 furthermore has the second solution circuit II represented at the top in the drawings, in which the sorption unit 14 representing the absorber of this second solution circuit is connected to an evaporator 32 by lines 34 and 36 with the inserted solution pump 38 and throttling means 40, respectively, and to an additional heat exchanger 42. In the evaporator 32, which is at a higher pressure $p_3$ than the sorption unit 14, thermal energy at a temperature $t_3 > t_2$ is put in and thus gaseous refrigerating component is driven out of the rich solution flowing in through line 34 into a connecting line 44 in which an expansion machine 46—e.g., an ammonia turbine—is disposed in which the pressure in the gaseous refrigerant is lowered to $p_2$, the expansion machine performing work which is converted in a generator 48 to electrical energy and/or can be used for the direct driving of additional machines such as the compressor 26. The branch of the connecting line 44 that follows the expansion machine is also connected to the branch line 28, i.e., the gaseous refrigerant component driven out in the evaporator 32 is fed back to the sorption unit 40. Since on the other hand the lines 34 and 36 of the solution circuit II are connected also to the sorption unit 14—which is indicated in FIG. 1 by connecting line 36 to line 16 just ahead of its entry into sorption unit 14 and by connecting line 34 to line 18 just after it emerges from the sorption unit 14—the solution circuits I and II are therefore not separated from one another but connected directly to one another. The sorption unit 14 must therefore be designed for the throughput of the amount of poor solution coming from the evaporator 12 and from desorber 32 and of the resorption or absorption of the gaseous refrigerant component driven out in the evaporator 12 and in the evaporator 32. Differences of concentration in the solution circuits I and II, that might impair the continuous operation of the apparatus 10, accordingly cannot occur, since the solution circuits are even coupled together.

The electrical energy produced in the electric generator 48 driven by the expansion machine 46 is produced as additional useful energy, from which, of course, the energy necessary for driving the compressor 26 must be deducted in calculating the overall efficiency of the apparatus.

Figure 4:
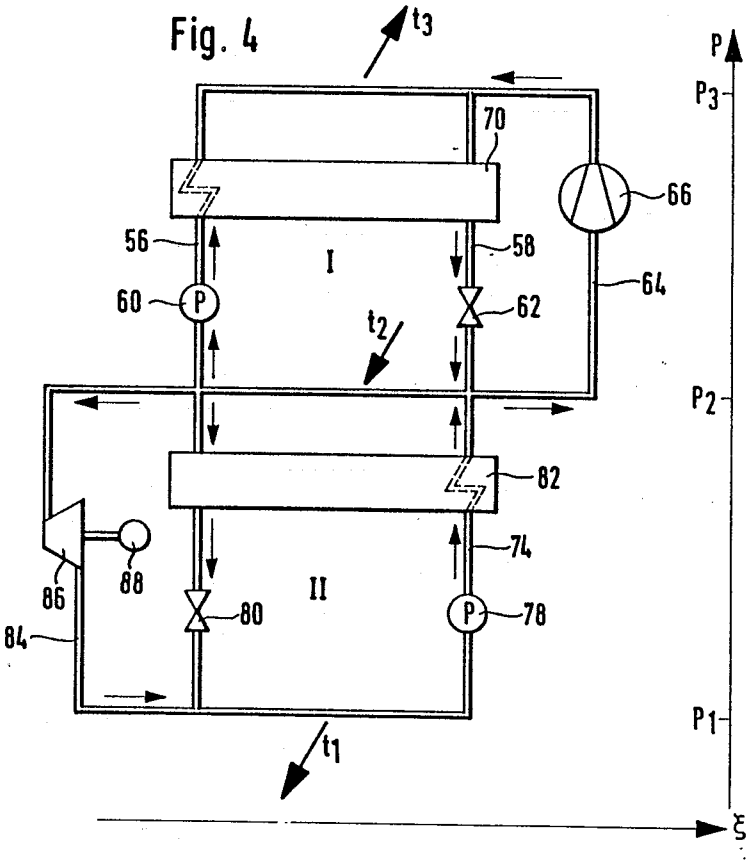
FIG. 4 shows the changes in the state of the refrigerant which take place in the heat engine in accordance with FIG. 3, in a p-$\xi$ graph.
Figure 3:
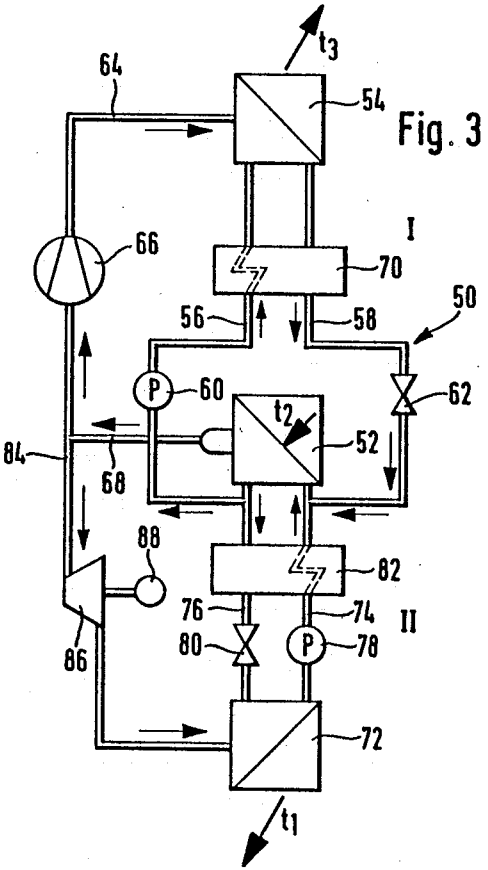
FIG. 3 is a circuit diagram of an embodiment of the thermal conversion apparatus in accordance with the invention which operates as a heat engine.

The thermal conversion apparatus shown in FIGS. 3 and 4, identified as a whole by 50, and operating as a heat engine, has basically the same construction as the thermal conversion apparatus 10, with two solution circuits I and II operated at different pressure levels and connected directly together at an intermediate pressure $p_2$, but the functional differences between a heat engine and a heat pump are to be noted. The solution circuit I represented at the top of the figures is constituted by an evaporator 52 which at the same time is part of the solution circuit II, and is connected to a resorber 54 by lines 56, 58, in which the solution pump 60 and throttle valve 62, respectively, are inserted. In the evaporator 52, which is at the intermediate pressure, gaseous refrigerant component is driven, by the input of heat at the temperature level $t_2$, out of the rich solution of the refrigerant fed through line 58, into a connecting line 68 connected to a connecting line 64 containing the compressor 66. The compressor 66 raises the gaseous refrigerant component flowing into it from the evaporator 52 to the pressure $p_3$ and pumps it to the resorber 54, where it is resorbed with removal of the resorption heat produced at the temperature $t_3$ in the poor solution flowing into it through line 56 after its pressure has been raised by the solution pump 60. The rich solution then flows through line 58 and, after loss of pressure in the throttling means 62, flows back to the evaporator 52. A heat exchanger 70 here again transfers thermal energy from the rich solution flowing in line 58 to the poor solution flowing in line 56. Solution circuit I therefore, here again, can be seen as a binary-refrigerant compression heat pump, and what has been stated about the improvement of the efficiency of such a compression heat pump by additional measures in connection with solution circuit I in apparatus 10 applies also to solution circuit I of thermal conversion apparatus 50. The thermal energy produced in resorber 52 with temperature $t_3 > t_2$ thus represents useful energy in this case.

Solution circuit II is constituted not only by the evaporator 52, which, as stated, also forms part of solution circuit I, but also by an absorber 72 which is connected to the evaporator 52 by lines 74, 76, containing solution pump 78 and throttling means 80, respectively, and, here again, heat is transferred by a heat exchanger 82 from the rich solution flowing in line 74 to the poor solution flowing in line 76. The branch line 68 connected to the evaporator 52 and carrying the released gaseous refrigerant component, is connected not only to connecting line 64, but also to an additional line 84 into which is inserted an expansion machine 86 driving a generator 88. Through the connecting line 68 a portion of the gaseous refrigerant component driven out in the evaporator 52 is returned, after pressure reduction in the expansion machine 86 to $p_1$, to the absorber 72, where it is absorbed, with removal of absorption heat, at a temperature level $t_1$, in the poor solution fed through line 76 and also lowered to the pressure $p_1$ in the throttling means 80. The solution thus enriched then flows through line 74 where its pressure is raised by the solution pump 78 to pressure $p_2$, and back to the evaporator 52. In this embodiment, too, the direct coupling of the two solution circuits I and II is again represented by the fact that lines 58 and 74, and 56 and 76, are represented as being connected directly together just ahead of the entry into and just after emerging from the evaporator 52, respectively. Differences in concentration between the solution circuits I and II, which would have to be compensated by separate measures, can not occur, therefore, even if the thermal conversion apparatus 50 should be operated as a heat engine.

What is claimed is:

1. A heat pump comprising: circuit means operated with a binary working medium for converting thermal energy supplied by an external heat source to thermal energy at a different temperature level, said circuit means comprising a first solution circuit having a forward pass and a return pass and a first evaporator at a first pressure level, compressor means for raising the pressure of a gaseous component of said binary working medium from said first evaporator to a higher pressure level in a resorber, said circuit means also comprising a second solution circuit having a forward pass and a return pass and a second evaporator at a second pressure level higher than said first level, expansion means for lowering the pressure of a gaseous component of said binary working medium of said second evaporator to a lower pressure level in an absorber, means free of control means, for directly coupling said forward pass of said first solution circuit with said return pass of said second solution circuit and said return pass of said first solution circuit with said forward pass of said second solution circuit at a common medium pressure level representing the higher pressure level in said first solution circuit and the lower pressure level in said second solution circuit.

2. A heat pump according to claim 1, wherein said resorber of said first solution circuit and said absorber of said second solution circuit are combined in a common sorption unit in which the gaseous working medium component driven out at low pressure and low temperature in said first evaporator of the first solution circuit is resorbed in the poor solution at an intermediate temperature after its pressure and temperature are raised by said compressor means, and the gaseous working medium component driven out at high pressure and high temperature in said second evaporator of the second solution circuit is absorbed in the poor solution at an intermediate temperature in the expansion means, with reduction of pressure and temperature, at the common medium pressure level.

3. A heat engine comprising: circuit means operated with a binary working medium for converting thermal energy supplied by an external heat source to thermal energy at a different temperature level, said circuit means comprising a first solution circuit having a forward pass and a return pass and a first evaporator at a first pressure level, compressor means for raising the pressure of a gaseous component of said binary working medium in said first evaporator to a higher pressure in a resorber, said circuit means also comprising a second solution circuit having a forward pass, a return pass and a second evaporator, expansion means for lowering the pressure of a gaseous component of said binary working medium in said second evaporator at a second pressure level to a lower pressure level in an absorber, and means, free of control means, for directly coupling said forward pass of said first solution circuit with said return pass of said second solution circuit and said return pass of said first solution circuit with said forward pass of said second solution circuit at a common medium pressure level representing the first pressure level of said first solution circuit and the second pressure level in said second solution circuit.

4. A heat engine in accordance with claim 3, wherein said first evaporator of the first solution circuit at said first pressure level and said second evaporator of the second solution circuit at said second pressure level are combined in a common evaporator in which the gaseous working medium component at the medium pressure level and at an intermediate temperature is driven out of the rich solution and then, after a partial increase in pressure and temperature by said compressor means, is fed to the resorber of the first solution circuit, and, after a partial reduction of pressure and temperature in the expansion means to the absorber of said second solution circuit.

* * * * *